United States Patent [19]

Bonneton et al.

[11] Patent Number: 4,604,115

[45] Date of Patent: Aug. 5, 1986

[54] METHOD AND INSTALLATION FOR TREATING A STORAGE SITE

[75] Inventors: Michel Bonneton, Grenoble; Bernard Marchal, Echirolles, both of France

[73] Assignee: L'Air Liquide, Societe Anonyme pour l'Etude et l'Exploitation des Procedes Georges Claude, Paris, France

[21] Appl. No.: 713,627

[22] Filed: Mar. 19, 1985

[30] Foreign Application Priority Data

Mar. 23, 1984 [FR] France ..... 84 04536

[51] Int. Cl.[4] ..... F25J 3/02

[52] U.S. Cl. ..... 62/11; 62/36; 62/53

[58] Field of Search ..... 62/9, 11, 40, 52, 53, 62/36

[56] References Cited

U.S. PATENT DOCUMENTS

| | | | |
|---|---|---|---|
| 2,909,906 | 10/1959 | Bocquet et al. | 62/9 |
| 3,018,632 | 1/1962 | Keith | 62/9 |
| 3,400,547 | 9/1968 | Williams et al. | 62/9 |
| 3,857,251 | 12/1974 | Alleaume | 62/40 |

*Primary Examiner*—Frank Sever

*Attorney, Agent, or Firm*—Young & Thompson

[57] ABSTRACT

The tank (1) is purged by gaseous nitrogen resulting from the vaporization of liquid nitrogen which has undergone an indirect heat exchange (2) with the gas issuing from the tank. This enables the purged products to be recovered. Application in the deballasting of ships transporting liquified petroleum gas or natural gas.

17 Claims, 4 Drawing Figures

METHOD AND INSTALLATION FOR TREATING A STORAGE SITE

FIELD OF THE INVENTION

The present invention relates to a method and installation for treating a storage site, and in particular for purging and rendering inert a tank. It is particularly applicable to the purging and the rendering inert of the tanks of ships transporting liquified natural gas (LNG) or liquified petroleum gas (LPG). However, it may also be applied to the purging and the rendering inert of other types of tanks containing imflammable, pollutant and/or costly volatile products.

BACKGROUND OF THE INVENTION

It is know that many tanks containing volatile products must be periodically purged and that it is then necessary to render them inert for safety reasons. This is in particular the case of the containers or tanks of ships transporting LNG or LPG after the cargo has been delivered.

In the conventional technique, this purging operation, which is often termed "deballasting", is carried out in two stages: bringing the tanks to surrounding temperature at sea and then, alongside the quay, injecting a neutral gas such as nitrogen. During this latter operation, the combustible gas expelled from the tanks under the effect of the thrust of the nitrogen, formed of light hyrocarbons, is sent to the flare. At the end of the deballasting operation, combustible gas is injected moreover into the mixture issuing from the tanks so as to obtain at the flare a stable combustible mixture until the complete stoppage of the deballasting.

This technique, which is at present very widely used, is unsatisfactory since it results, on one hand, in loss of time and money (useless circulation of the ships) and, on the other hand, in losses of fuel, estimated to be between 2% and 5% of the cargo, depending on the liquified gas storage pressure. Similar drawbacks are met with in the other aforementioned cases.

SUMMARY OF THE INVENTION

An object of the invention is to provide a method and an installation whereby it is possible to recover the essential part of the gaseous products expelled from the storage site during the purge in a cheap manner.

The invention therefore provides a method for treating a storage site, and in particular for purging and rendering inert a tank, of the type in which a gaseous product contained in said site is expelled by injecting therein nitrogen, said method comprising effecting an indirect exchange of heat between the gas issuing from said site and liquid nitrogen, so as to partly condense said gas, and injecting in said site the gaseous nitrogen resulting from said vaporization of liquid nitrogen.

Another object of the invention is to provide an installation for treating a storage site, and in particular for purging and rendering inert a tank, adapted to carry out said method. This installation comprises: a phase separator; a storing vessel communicating with the phase separator; and an indirect heat exchanger including first passageways for connection on the upstream side to said site and for connection on the downstream side to said separator, and second passageways connected on the upstream side to a source of liquid nitrogen and adapted to be connected on the downstream side to said site.

BRIEF DESCRIPTION OF THE DRAWINGS

Some embodiments of the invention will now be described with reference to the accompanying drawings in which FIGS. 1 to 4 diagrammatically illustrate four ways of carrying out the method according to the invention.

DETAILED DESCRIPTION

In all the represented embodiments, there is shown an installation for purging, so as to render it inert, a tank 1 which is for example a tank of a ship transporting LNG or LPG. The installation comprises a counter-current indirect heat exchanger 2, a phase separator 3 and a vessel 4 for storing the recovered liquid products.

Figure 1:
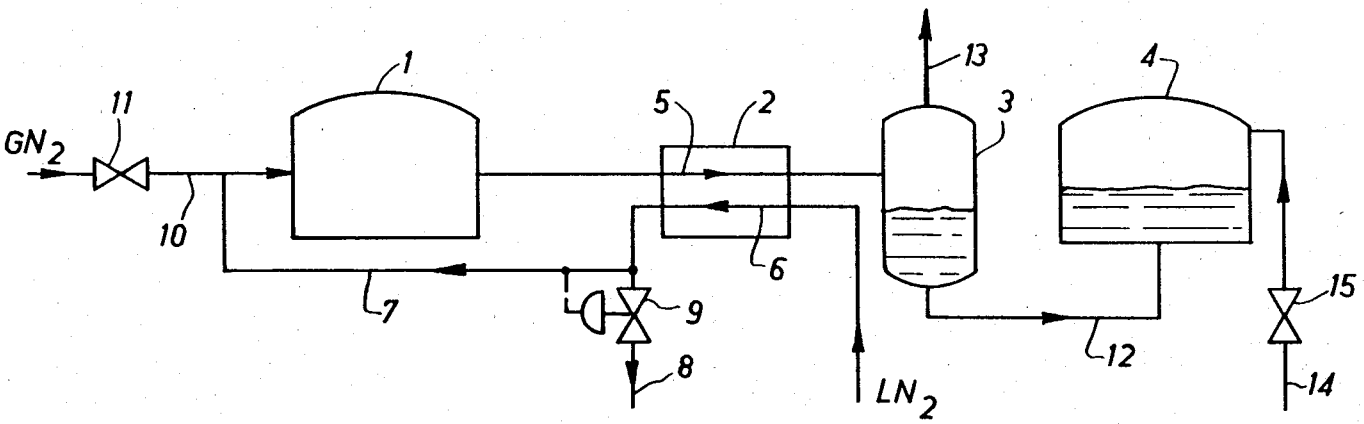

In FIG. 1, the exchanger 2 comprises first passageways 5 which are connected on the upstream side to the tank 1 and on the downstream side to the separator 3, and second passageways 6 connected on the upstream side to a source of liquid nitrogen and on the downstream side to the tank 1 through a conduit 7. Branch connected to the conduit 7 is a venting conduit 8 provided with a valve 9 controlled by the pressure prevailing in the conduit 7. An auxiliary gaseous nitrogen supply conduit 10 provided with a valve 11 and supplied with nitrogen by an exterior nitrogen source, is connected to the conduit 7 downstream of the venting conduit 8.

The base of the separator 3 is connected to the base of the vessel 4 through a conduit 12, and the top of the separator is provided with a vent 13 provided with a pressure limiter (not shown). Further, a conduit 14 provided with a valve 15 supplies gaseous nitrogen to the upper part of the vessel 4 from an exterior source of nitrogen.

In operation, liquid nitrogen is vaporized in the exchanger 2 in counter-current with the gas issuing from the tank 1. This gas is thus partly condensed and the liquid obtained is received in the separator 3 and transferred to the vessel 4 through the conduit 12.

The gaseous nitrogen vaporized in the exchanger 2 is conducted through the conduit 7 to the tank 1 on the opposite side of the latter to the outlet orifice of the gases of this tank, and urges the gaseous contents of the tank toward the passageways 5 of the exchanger 2. Thus, the nitrogen is used firstly for its refrigerating power and then secondly for its mechanical energy and its inert-rendering properties.

As the operation progresses, the content of combustible gas in the gas issuing from the tank diminishes. Consequently, the amount of liquid nitrogen required for recovering the combustible gas also diminishes and a moment is reached when the rate of flow of vaporized nitrogen is no longer sufficient for effectively purging the tank. Additional gaseous nitrogen is then injected through the conduit 10.

Figure 2:
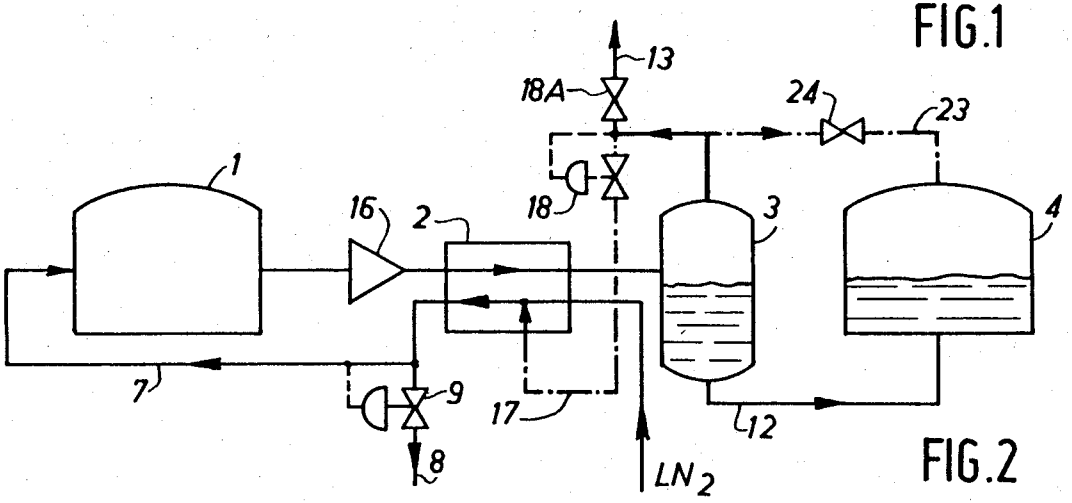

As shown in FIG. 2, if the pressure prevailing in the tank 1 is insufficient and it cannot be envisaged to increase it to a marked extent, a compressor 16 may be mounted between the outlet of the tank 1 and the inlet of the passageways 5. The gas formed in the spearator 3 can then be reinjected into the passageways 6 of the exchanger 2 which conveys the liquid nitrogen, through a conduit 17 which is provided with a valve 18 controlled by the pressure of the separator. Such a reinjection, however, presupposes that the content of product to be recovered in the gas of the separator is sufficiently low so that it intervenes only at a stage which is already advanced in the purging operation, in a phase where in fact the nitrogen rate of flow required for the condensation is no longer sufficient to assure an effective purge. The vent 13 is provided with a control valve 18A.

If the gas contained in the tank 1 is very cold, the diagrammatic representation in FIG. 2 assumes that there is available a compressor 16 of cryogenic type. In the modification shown in FIG. 3, it may be of greater interest to employ a cheaper ordinary compressor and an auxiliary exchanger 19 ensuring a counter-current indirect thermal exchange between the gas entering the compressor and the gas leaving the compressor. Apart from this difference, the arrangement shown in FIG. 3 is identical to that shown in FIG. 2.

Figure 4:
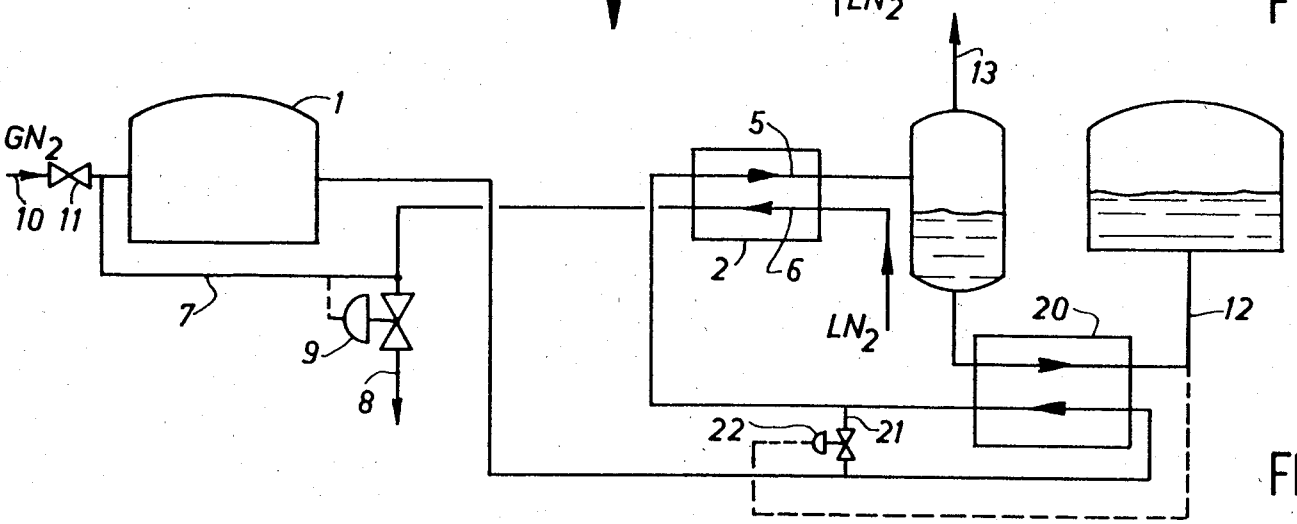

FIG. 4 illustrates a modification of the diagrammatic representation of FIG. 1 whereby it is possible to increase the recovery to a high degree without increasing the pressure of the gas issuing from the tank, and therefore without using a compressor and a heat exchanger adapted to withstand high pressures. For this purpose, the temperature in the exchanger 2 must be lowered and this results in the presence of a sub-cooled liquid in the separator 3. This liquid is therefore reheated in the conduit 12 by causing it to cool the gas issuing from the tank 1 before this gas enters the passageways 5 of the main exchanger 2. In other words, the auxiliary heat exchanger 20 effects a counter-current exchange of heat between the outlet conduit of the tank 1 and the conduit 12, and the treated gas is pre-cooled before exchanging heat with the liquid nitrogen. It will be understood that this modification improves the thermal balance of the installation.

FIG. 4 also shows a by-pass conduit 21 connecting the sections of the outlet conduit of the tank on the upstream and downstream side of the exchanger 20. This by-pass conduit is provided with a valve 22 controlled by the temperature prevailing in the conduit 12 on the downstream side of the exchanger 20. Thus, the flow of gas through this exchanger is controlled by the amount of heat exchanged.

Figure 3:
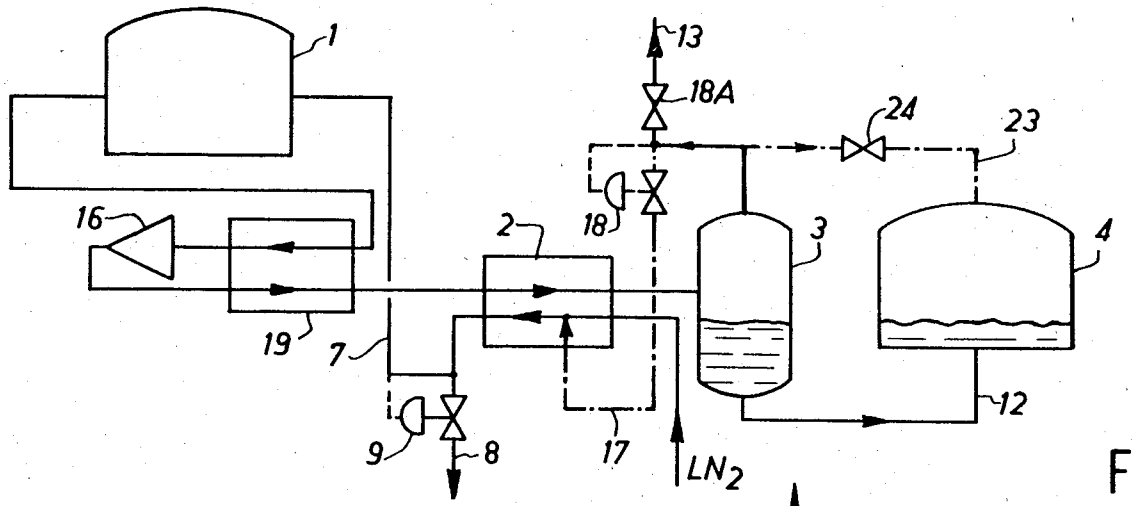

In each embodiment, it is possible to return gas issuing from the separator 13 to the upper part of the vessel 4 so as to render the latter inert, as shown by a conduit 23 provided with a valve 24 in FIGS. 2 and 3.

It will be understood that the method and installation according to the invention may be applicable to many cases where it is necessary to purge a tank of a gaseous content which is costly, polluting, etc., for example to purge a tank of ammonia, acid, hydrocarbons, etc.

We claim:

1. A method for treating a storage site, and in particular for purging and rendering inert a tank, comprising minimizing the loss of time and maximizing the recovery of a gaseous product, otherwise resulting from conventional purging, by expelling a said gaseous product contained in said site by injecting nitrogen therein, effecting an indirect heat exchange between the gas issuing from said site and liquid nitrogen so as to partly condense said gas, and injecting into said site gaseous nitrogen resulting from said vaporization of liquid nitrogen.

2. A method according to claim 1, for purging and rendering inert a tank, comprising injecting said gaseous nitrogen into the tank at an opposite end of the tank to an outlet orifice for the gases of said tank.

3. A method according to claim 1, further comprising, in an advanced stage of the method, effecting a heat exchange between the gas issuing from said site and the gas resulting from said partial condensation, the latter gas being added to said gaseous nitrogen.

4. A method according to claim 1, comprising sending the gas resulting from said partial condensation into an upper part of a vessel storing the liquid recovered upon said condensation.

5. A method according to claim 1, comprising compressing the gas issuing from said site.

6. A method according to claim 5, for a storage site containing a gaseous product at low temperature, comprising effecting an indirect heat exchange between the gas issuing from said site and the compressed gas.

7. A method according to claim 1, comprising effecting an indirect heat exchange between the gas issuing from said site and the liquid resulting from said partial condensation.

8. A method according to claim 1, comprising, in an advanced stage of the method, completing said injection of gaseous nitrogen by an injection into said site of gaseous nitrogen coming from an exterior source.

9. An installation comprising: means for treating a storage site, and in particular for purging and rendering inert a tank, sufficient to minimize the loss of time and to maximize the recovery of a gaseous product, otherwise resulting from conventional purging, including a phase separator; a storage vessel communicating with the phase separator; and an indirect heat exchanger comprising first passageways for connection on the upstream side of the heat exchanger to said site and connection on the downstream side of the heat exchanger to the separator, and second passageways connected on the upstream side of the heat exchanger to a source of liquid nitrogen and for connection on the downstream side of the heat exchanger to said site.

10. An installation according to claim 9, for purging and rendering inert a tank, wherein said first and second passageways are adapted to be connected to orifices of the tank which are in opposed relation to each other.

11. An installation according to claim 9, comprising a compressor interposed between said site and an inlet of said first passageways of the heat exchanger.

12. An installation according to claim 11, comprising an auxiliary indirect heat exchanger including third passageways connected to a lower part of the phase separator and a lower part of the storage vessel, and fourth passageways for connection on the upstream side of the auxiliary heat exchanger to said site and for connection on the downstream side of the auxiliary heat exchanger to an inlet of said first passageways.

13. An installation according to claim 11, comprising an auxiliary indirect heat exchanger which puts in thermal exchange relation an inlet conduit and an outlet conduit of the compressor.

14. An installation according to claim 11, comprising an auxiliary indirect heat exchanger including third passageways connected to a lower part of the phase separator and a lower part of the storage vessel and fourth passageways for connection on the upstream side of the auxiliary heat exchanger to said site and for connection on the downstream side of the auxiliary heat exchanger to an inlet of said first passageways, and an auxiliary indirect heat exchanger which puts in thermal exchange relation an inlet conduit and an outlet conduit of the compressor.

15. An installation according to claim 9, comprising means for sending gas issuing from the separator into said second passageway.

16. An installation according to claim 9, comprising means for sending gas issuing from the separator into said storage vessel.

17. An installation according to claim 9, comprising means for sending gas issuing from the separator into said second passageways and into the storage vessel.

* * * * *